US005494377A

United States Patent [19]

Garofalo

[11] Patent Number: 5,494,377

[45] Date of Patent: Feb. 27, 1996

[54] DEVICE FOR THE RAPID ATTACHMENT AND RELEASE OF AQUALUNG CYLINDERS TO AND FROM THE BACK OF A STABILIZER JACKET

[75] Inventor: Giovanni Garofalo, Genoa, Italy

[73] Assignee: HTM Sport S.p.A., Italy

[21] Appl. No.: 322,303

[22] Filed: Oct. 4, 1994

[30] Foreign Application Priority Data

Oct. 20, 1993 [IT] Italy ..... GE93A0089

[51] Int. Cl.[6] ..... B63C 11/02

[52] U.S. Cl. ..... 405/186; 224/211; 224/269

[58] Field of Search ..... 405/186; 224/269, 224/270, 271, 211; 114/315; 441/86, 106

[56] References Cited

U.S. PATENT DOCUMENTS

| | | | |
|---|---|---|---|
| 2,120,420 | 6/1938 | Topper | 405/186 |
| 2,864,101 | 12/1958 | Kissenberger | 224/211 X |
| 3,174,664 | 3/1965 | Hue | 224/211 |
| 4,310,110 | 1/1982 | Dexter | 224/211 X |
| 4,640,215 | 2/1987 | Purifoy, Jr. . | |
| 5,271,387 | 12/1993 | Murray | 224/271 X |

FOREIGN PATENT DOCUMENTS

| | | | |
|---|---|---|---|
| 2651203 | 3/1991 | France | 405/186 |
| 9209740 | 7/1992 | France . | |
| RE91A00071 | 10/1991 | Italy . | |
| 199912 | 10/1994 | Italy . | |
| 8503022 | 11/1985 | Netherlands . | |

*Primary Examiner*—Dennis L. Taylor
*Attorney, Agent, or Firm*—Larson and Taylor

[57] ABSTRACT

Device for the rapid attachment and release of aqualung cylinders to and from a back structure comprising: a rigid support which is connected to the cylinders by means of belts and is provided at one end with a blocking recess, and a back structure which can be connected to the stabilizer jacket and is fitted with a transverse bar which couples with the recess in the rigid support. This back structure is provided near the end opposite the transverse bar with a pin which may be coupled to a mating hole disposed near the end opposite the recess. A spring clamp cooperates with said hole so as to disengageably lock said pin whenever inserted in the said hole.

3 Claims, 4 Drawing Sheets

DEVICE FOR THE RAPID ATTACHMENT AND RELEASE OF AQUALUNG CYLINDERS TO AND FROM THE BACK OF A STABILIZER JACKET

BACKGROUND OF THE INVENTION

The present invention relates to devices for connnecting a back structure to one or more air cylinders, it particularly relates to devices for the attachment and release of one or more air cylinders to and from a back structure, more especially to and from the back of a stabilizer jacket.

For some time systems have been known which allow one or more suitably arranged air cylinders to be attached to and released from a back structure which is then either put on directly via suitable belts or is connected to a stabilizer jacket of known type. The latter solution, in particular, has the greatest advantages, both from the point of view of practicality and of comfort, and is certainly the most commonly used nowadays. Attachment and release of the air cylinders to and from the back structure must, of course, be as simple and quick as possible.

In order to achieve this rapid release numerous systems have been designed in the state of the art. Particularly significant in this respect are those described in the Dutch patent application 8503022, in the French patent application 9209740 and in the Italian patent application RE91A00071.

The Dutch patent application 8503022 describes a device formed by a carrying element and by a rod which can be inserted therein, the secure connection of which is provided by a ratchet which can be released by pulling an appropriate chain.

The French application 9209740 describes an attachment system consisting of two threaded pins located on the air cylinder or cylinders, and coupled to a pair of nut- and bolt fasteners inserted in the back structure; in this case the attachment is released by pulling a small cord connected to two hooks inserted in the nut- and bolt fasteners.

In the Italian patent application RE91A00071 the attachment involves elements located on both the air cylinder or cylinders and the back structure, locking one inside the other; one of these interlocking pairs has a pin and recess for accommodating the pin, respectively. The pin can be disengaged from the recess, resulting in the release of the attachment, by pulling on a handle.

As may be noted from the above description, the common factor in the three abovementioned devices is that the release mechanism is actuated by exerting a pulling force. Thus, systems of this type have the common disadvantage that they are relatively vulnerable to knocks or other accidental action which might inadvertently unlock the attachment mechanism and are, therefore, not very reliable.

Undoubtedly reliable, from the point of view of the stability of the attachment, are the systems described in U.S. Pat. No. 4,640,215 and in the Italian Patent for a utility model No. 199912. However, both these systems do not allow, or at least not without difficulty, the air cylinder to be rapidly disengaged from the stabilizer jacket, on the contrary (especially in the case of the U.S. patent) requiring the help of a second person to disengage the air cylinder or, at the very least, requiring the jacket to be taken off in order to do so.

SUMMARY OF THE INVENTION

The present invention proposes to overcome these drawbacks by providing a device that enables the air cylinder or cylinders to be rapidly attached to and released from the back structure, yet without running the risk of being accidentally released as a result of knocks or other adverse events.

This object is achieved by means of the device according to the present invention comprising: a rigid support which is connected to the cylinder or cylinders by means of suitable belts and is provided at one end with a blocking recess, and a connecting back structure which can be connected to the stabilizer jacket and is fitted with a transverse bar which couples with the recess in the rigid support, characterized in that the said back structure has a pin which is inserted perpendicularly therein, and in that the said support has a hole and a spring clamp with two arms inside the said hole and in alignment with this, the said pin being inserted into the said hole and being locked in position by the arms of the spring clamp.

Advantageously the said rigid support has a belt within it which is fixed to pins and which enables the air cylinder or cylinders to be easily transported when the device is disconnected.

A device designed in this way will enable the air cylinder or cylinders to be rapidly and easily attached to and released from the back structure without exhibiting risks inherent in state of the art devices since it is virtually impossible to unlock the mechanism accidentally.

BRIEF DESCRIPTION OF THE DRAWINGS

Other advantages and features will be made clearer in the following detailed description of an embodiment of the present invention, given by way of non-limiting example and with reference to the appended drawings in which.

DESCRIPTION OF THE PREFERRED EMBODIMENT OF THE INVENTION

Figure 1:
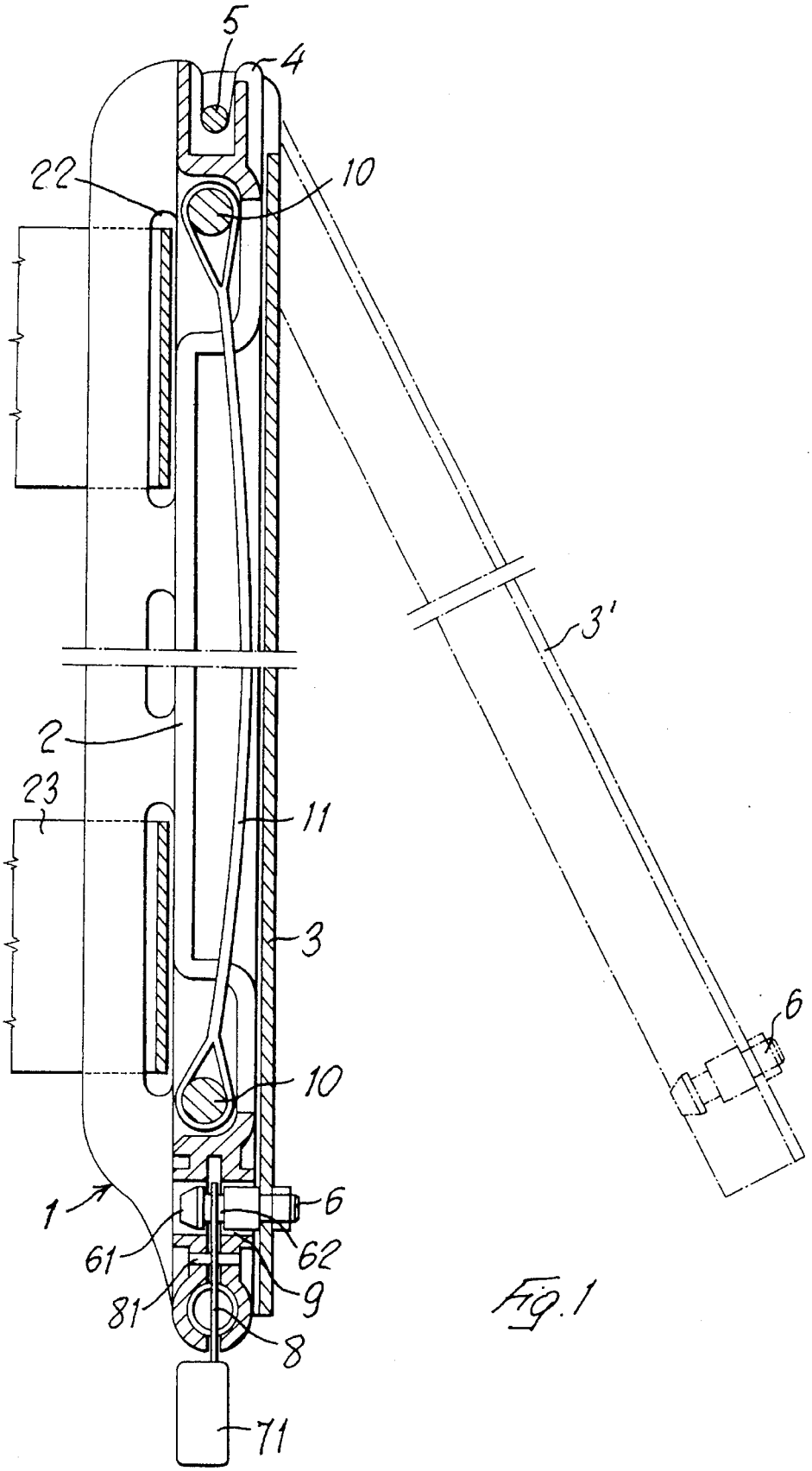
FIG. 1 is a longitudinal sectional view of the device according to the present invention.

FIG. 1, 1 designates the device according to the present invention. The said device, shown here in section, comprises a rigid support 2 (see FIG. 2) of rectangular shape fitted with wings 21 along its long sides. These wings have holes 22 through which run the belts 23 for connecting the support 2 to the air cylinder 20 (see FIGS. 2 and 4). This support 2 has a recess 4 at one end, while at the opposite end there is a clamp 7 loaded by a spring 12, the arms 8 of which clamp, which pivot on the support at 81, meet in alignment with the hole 9 which opens onto the surface of the support 2.

Accommodated within the support 2, in a depression 24, is a belt 11 secured to two pins 10, the function of which will be explained later.

Figure 3:
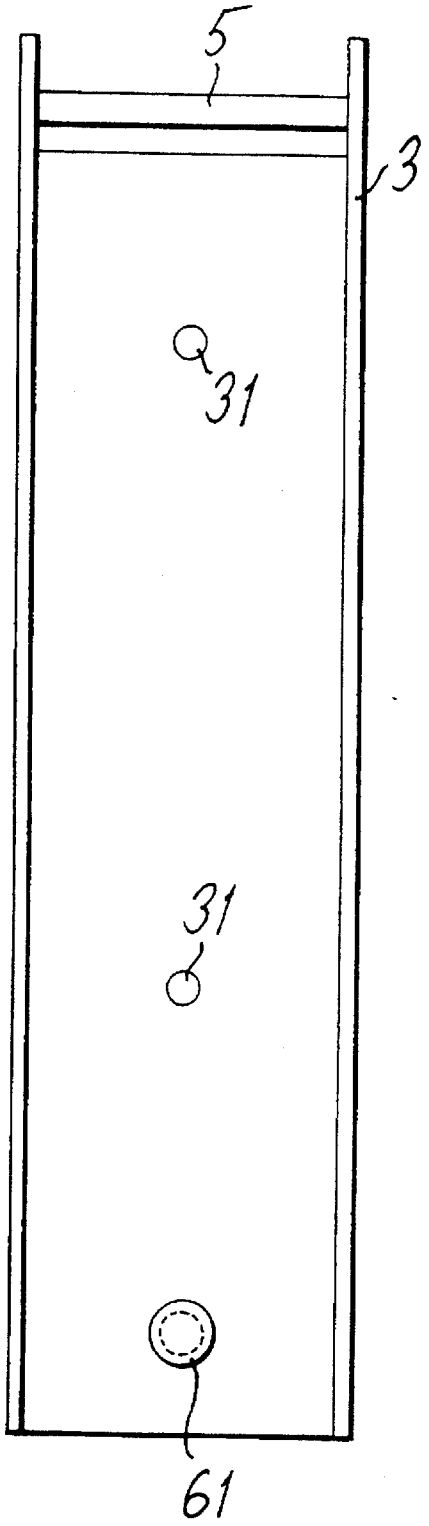

A back structure 3 (see FIG. 3) is connected to the said support 2 of the device 1. This back structure is a strip of material in the shape of a rectangle and is the same size as the support 2 without the wings 21. This back structure 3 has a transverse bar 5 at one end and a pin 6 perpendicular to the surface of the said back structure in the vicinity of the other end, along the line of the major axis. Finally, the said back structure has one or more holes 31 along its major axis.

Figure 2:
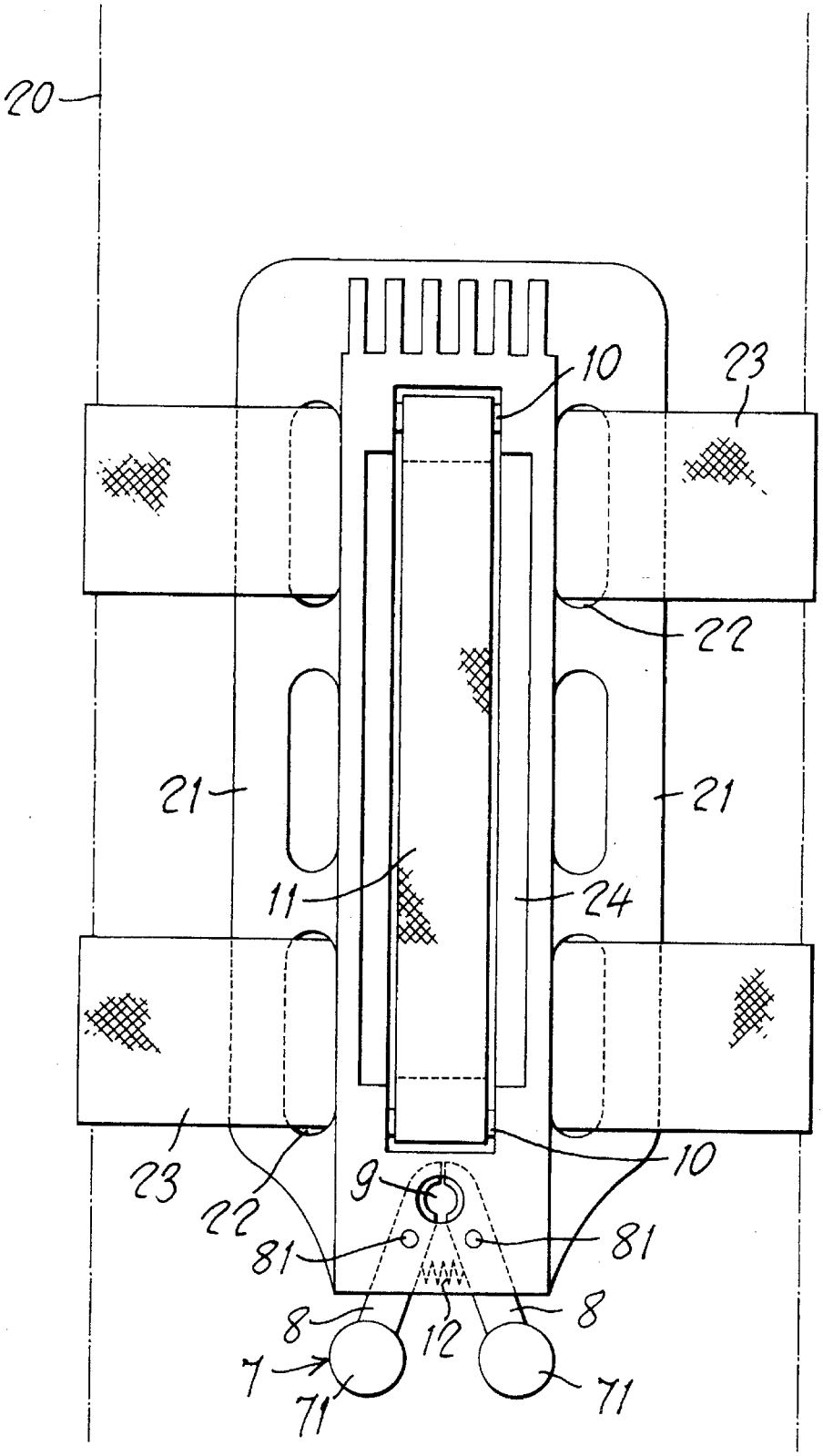
FIGS. 2 and 3 are plan views of the support and of the back structure which can be connected to it, respectively.
Figure 4:
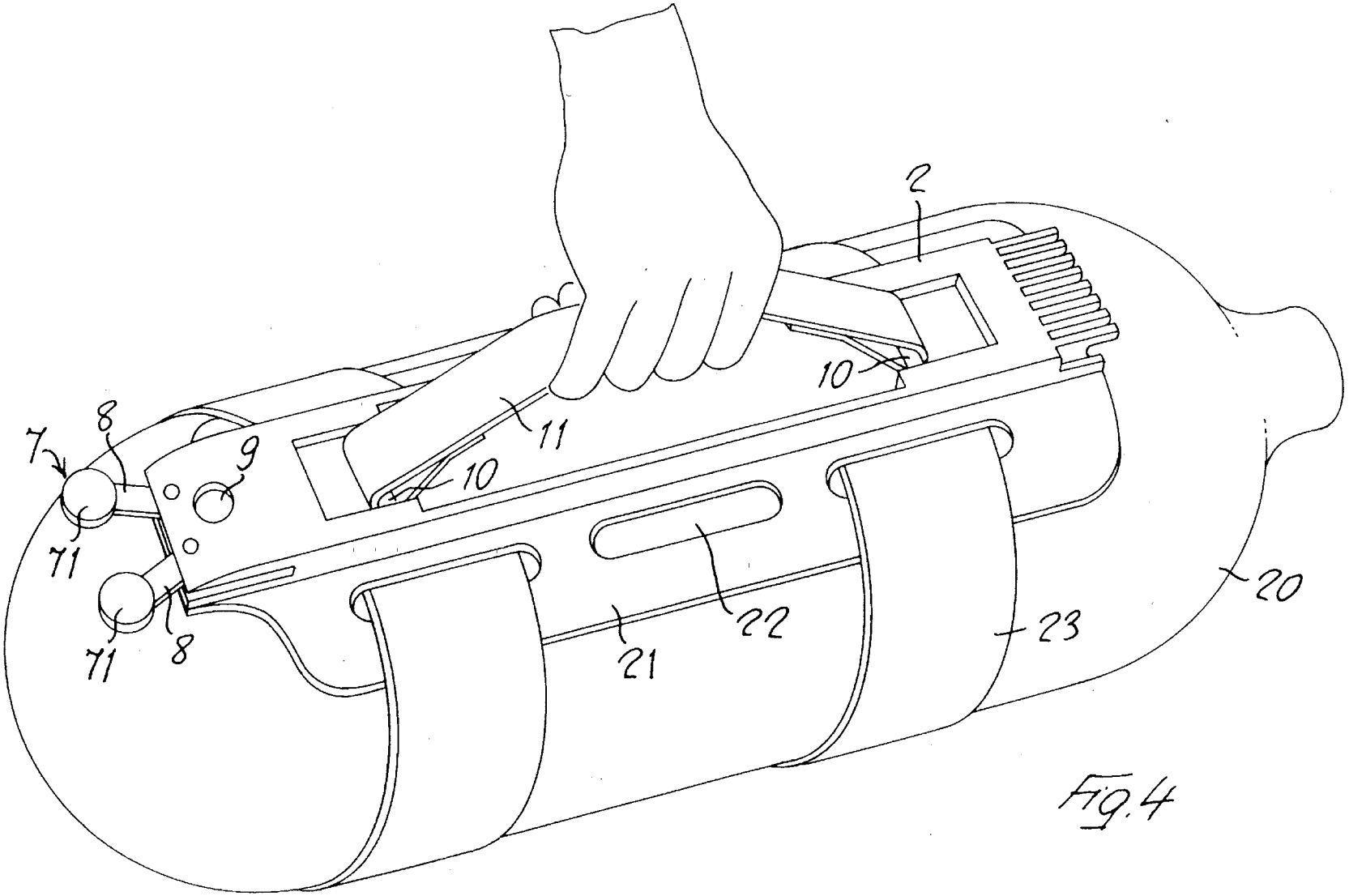
FIG. 4 is a perspective view of the air cylinder fitted with the support for the device according to the present invention.

The support 2 is fastened to the air cylinder 20 by means of the belts 23 which pass through the holes 22, as illustrated in FIGS. 2 and 4. The back structure 3 can then be connected to it in the manner illustrated in FIG. 1; that is to say, the transverse bar 5 is firstly inserted into the recess 4 and then the locking pin 6 is placed in the hole 9 in the support 2. Once inside the said hole 9, the frustoconical tip 61 of the pin 6 is inserted behind the arms 8 of the clamp 7, and the shank 62 of the pin 6 is locked in position by the ends of the said arms 8. In this way the back structure 3 is secured to the support 2.

In order to release it, one merely has to push together the knobs 71 at the opposite end of the arms 8 of the clamp 7 in order to open the said arms and enable the tip 61 to come out from the hole 9.

Even though this operation is very quick and easy to execute, it does not involve the risk of accidental release inherent in state of the art devices.

Advantageously the holes 31 in the back structure 3 enable it to be secured, using suitable means, to a stabilizer jacket.

FIG. 4 shows the air cylinder 20 fitted with the support 2, the said support being disconnected from the back structure 3. In this situation, it is very easy to grip the belt 11 attached to the support in the manner described previously, and transport the air cylinder without difficulty.

I claim:

1. Device for the rapid attachment and release of aqualung cylinders to and from a back structure comprising a rigid support connected to the said cylinders by means of belts and provided at one end with a blocking recess, and a back structure which can be connected to a stabilizer jacket; said back structure being fitted with a transverse bar which couples with said blocking recess in said rigid support, wherein said back structure is provided with a pin extending outwardly at right angles from said structure in the vicinity of the end of said back structure opposite to said transverse bar, said pin being provided near its free end with coupling means, and said support being provided with a hole near its end opposite to said blocking recess, said hole being apt to accomodate said pin, and clamping means urged into clamping direction by spring means, said clamping means cooperating with said coupling means formed in said pin whenever said pin is inserted into said hole in order to lock said pin into said hole until the said clamping means are urged apart against the force of the said spring means.

2. A device according to claim 1, in which said coupling means on said pin are in the form of a circumferential groove, and said clamping means are in the form of two clamping arms which may engage said groove.

3. A device according to claim 1, in which the said support is provided with a depression extending along its length in which a belt endwise secured to two pins is housed.

* * * * *